US008332993B2

(12) United States Patent
Roger

(10) Patent No.: US 8,332,993 B2
(45) Date of Patent: Dec. 18, 2012

(54) SLIDER FOR ACTUATING PROFILED SHAPES WITH STIFFENING BARS

(75) Inventor: Antony Roger, Sartrouville (FR)

(73) Assignee: S2F Flexico, Henonville (FR)

( * ) Notice: Subject to any disclaimer, the term of this patent is extended or adjusted under 35 U.S.C. 154(b) by 215 days.

(21) Appl. No.: 12/651,787

(22) Filed: Jan. 4, 2010

(65) Prior Publication Data

US 2010/0170900 A1 Jul. 8, 2010

(30) Foreign Application Priority Data

Jan. 5, 2009 (FR) ..... 09 50005

(51) Int. Cl.
*A44B 19/26* (2006.01)

(52) U.S. Cl. ..... 24/427; 24/400

(58) Field of Classification Search ..... 24/585.11, 24/585.12, DIG. 50, DIG. 39, DIG. 40, 30.5 R, 24/399, 400, 427; 383/61.2, 61.3, 63, 64; 53/412; 493/213
See application file for complete search history.

(56) References Cited

U.S. PATENT DOCUMENTS

| | | | | |
|---|---|---|---|---|
| 2,665,467 | A * | 1/1954 | Bosomworth et al. | 24/400 |
| 6,419,391 | B2 | 7/2002 | Thomas | |
| 6,584,666 | B1 * | 7/2003 | Savicki | 29/408 |
| 6,611,996 | B2 | 9/2003 | Blythe et al. | |
| 7,134,192 | B1 | 11/2006 | Savicki et al. | |
| 7,574,782 | B2 * | 8/2009 | Ackerman | 24/400 |
| 7,797,802 | B2 | 9/2010 | Ackerman | |
| 2002/0064320 | A1 | 5/2002 | May | |
| 2005/0160566 | A1 * | 7/2005 | Chang | 24/427 |
| 2006/0265844 | A1 | 11/2006 | Ackerman | |
| 2007/0269144 | A1 | 11/2007 | Arnell | |
| 2008/0159663 | A1 * | 7/2008 | Pham | 383/64 |
| 2010/0170901 | A1 | 7/2010 | Roger | |

FOREIGN PATENT DOCUMENTS

| | | | |
|---|---|---|---|
| FR | 2 924 312 | A1 | 6/2009 |
| WO | WO 99/16326 | A1 | 4/1999 |

OTHER PUBLICATIONS

French Search Report, issued on Nov. 20, 2009, for application No. FR 0950005.
Office Action issued in U.S. Appl. No. 12/651,791 on Sep. 20, 2011.

* cited by examiner

*Primary Examiner* — James Brittain
(74) *Attorney, Agent, or Firm* — Foley & Lardner LLP

(57) ABSTRACT

A slider actuates profiled closure shapes for a closure assembly equipping a sachet. The slider includes a base, two flanks, means adapted for stressing respectively said profiled closure shapes, by moving towards or moving away according to a direction of displacement of the slider along the profiled closure shapes, such that the profiled closure shapes are movable between a closed latch position and an open separated position, and a stiffening bar extending along a longitudinal free edge of each of the two flanks. The stiffening bar has a greater thickness than a thickness of its respective flank, extends over an external face of its respective flank, is made from a piece with its respective flank, and has a same longitudinal range as its respective flank.

14 Claims, 3 Drawing Sheets

PRIOR ART

SLIDER FOR ACTUATING PROFILED SHAPES WITH STIFFENING BARS

The present invention relates to the field of sachets provided with complementary profiled closure shapes, actuated by a slider.

It relates more precisely to a slider for actuating profiled closure shapes for a closure assembly equipping a sachet.

Numerous sachets with complementary profiled closure shapes equipped with sliders have already been proposed.

The attached FIG. 1 illustrates an example of a slider 1 in keeping with the prior art.

In this figure, the profiled shapes with which the slider is supposed to cooperate have been illustrated and bear the reference $P_1$ and $P_2$, whereas the sachet with which these profiled shapes are associated is referenced S.

Such a slider 1 is made of moulded plastic material and has a generally known structure.

More precisely, this slider has a cross-section in an inverse "U" shape, and comprises a base 10 to which are connected two lateral and parallel wings 11 and 12 known as "flanks". The longitudinal axis of the slider corresponds to its direction of movement when it is installed on a sachet with complementary profiled shapes. The flanks 11 and 12 extend parallel to this axis.

As is well known per se, the internal space of the slider encloses means 13 adapted for stressing the complementary profiled closure shapes $P_1$ and $P_2$ of the sachet, by moving towards or moving away according to the direction of displacement of the slider along these profiled shapes. The expression "internal space" means the space delimited by the base 10 and the flanks 11 and 12.

Such a slider must be placed on a sachet S whereof the two sails are provided with complementary profiled closure shapes $P_1$ and $P_2$.

The technique generally utilised to achieve this consists overall in deforming the slider so as to momentarily move its flanks 11 and 12 away from one another (arrow f of FIG. 1), moving the profiled shapes closer to "cinch" the latter and trap the protuberances $T_1$ and $T_2$ with which they are provided, then return the flanks to their initial position (arrows g of FIG. 1).

This displacement of the flanks is implemented for example by introducing tools "inside" the slider, applying them against the inner faces of the flanks and moving them away mutually.

Particularly due to the slight thickness of the wall which makes up the flanks, it is noted that the latter do not deform uniformly, but they have a tendency to assume an arched position in the longitudinal and/or transversal direction. This makes it more difficult to place the profiled shapes.

It is understood that transmission of forces applied by the tools is not fully given over to moving the flanks apart, part of the latter being accidentally "wasted" and dedicated to their deformation in an arched position.

SUMMARY

The aim of the present invention is to resolve this problem by proposing a slider whereof the flanks can be moved apart from one another without "parasitic" deformation of their wall.

The present invention accordingly relates to a slider for actuating profiled closure shapes, especially for a closure assembly equipping a sachet, comprising a base, two flanks, and means adapted for stressing respectively said profiled closure shapes, by moving towards or moving away in the direction of displacement of the slider along profiled shapes, for moving the profiled shapes between a closed latch position and an open separated position.

This slider is remarkable in that, along the longitudinal free edge of each flank extends a stiffening bar, of a greater thickness than that of said flank.

The presence of this bar on each flank imparts substantial rigidity to the assembly thereof, such that when it is subjected to forces liable to displace it relative to its normal position, all the forces applied are dedicated to this operation.

According to other advantageous and non-limiting characteristics of this slider:

- said bar extends over the external face of each flank;
- said bar has a constant thickness and the bar thickness/flank ratio is between 1.5 and 2.5;
- said bar is made of a single piece with the associated flank;
- said bar has the same longitudinal range as said flank;
- it comprises projecting load pins on said flanks, in the vicinity of the end of those opposite said base, for opening it provisionally and enabling its engagement on said profiled shapes when stress is exerted on said pins;
- the means adapted to stress respectively said profiled closure shapes, by moving towards or moving away in the direction of displacement of the slider along the profiled shapes, to move the profiled shapes between a latched closure position and an open separated position, comprise a longitudinal rib which subdivides at least part of its inner space into two corridors, this rib extending by a base which overflows on either side of said rib to constitute guide facets of a protuberance associated with said profiled shapes, Other characteristics and advantages of the invention will emerge from the following detailed description of a preferred embodiment.

BRIEF DESCRIPTION OF THE DRAWINGS

This description will be given in reference to the attached diagrams, in which.

DETAILED DESCRIPTION

Figure 1:
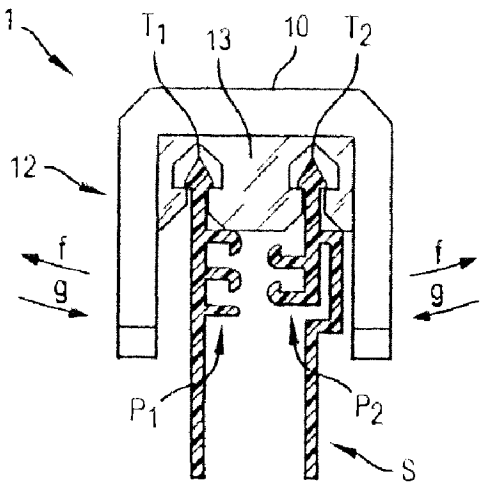
FIG. 1 illustrates an example of a slider according to the prior art.
Figure 6:
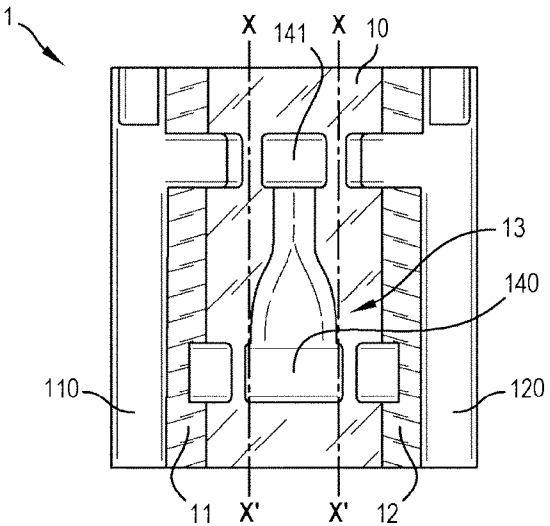
FIGS. 6 and 7 are views equivalent to those in FIGS. 4 and 5, the flanks being illustrated in a spread position.
Figure 7:
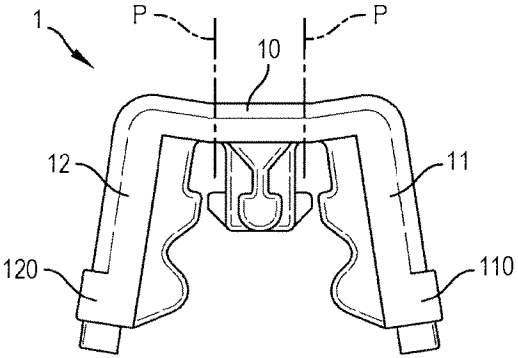
Figure 4:
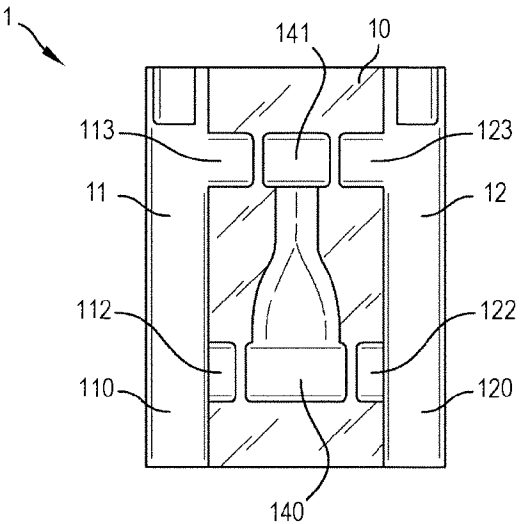
FIG. 4 is a bottom view of the slider of FIG. 2.

The slider of the invention overall has a structure known per se, close to that of FIG. 1.

As with this known slider, the slider according to the invention has a cross-section in an inverse "U" shape, with a base 10 to which are attached two lateral and parallel wings (or flanks) 11 and 12.

Figure 2:
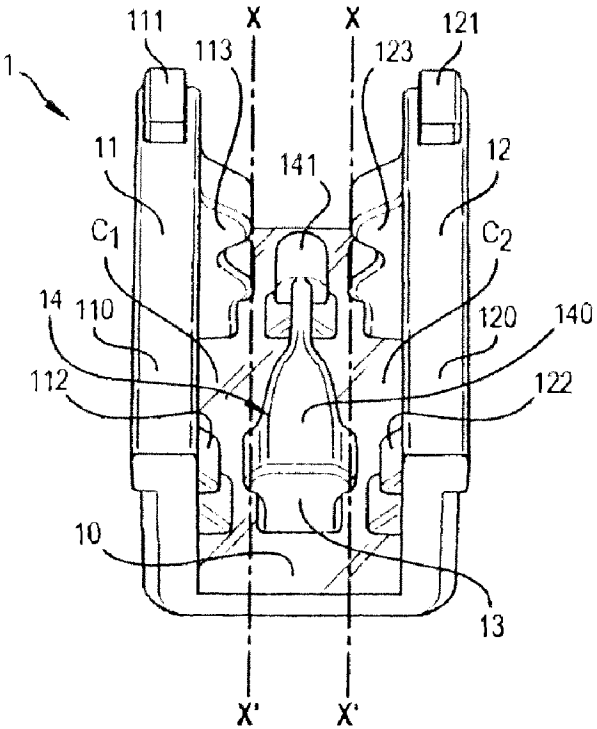
FIG. 2 is a perspective view of a slider according to the invention, presented in reversed position.

In FIG. 2, it is presented in a position opposite to the one it occupies when it is in place on a sachet.

The internal space of the slider encloses means adapted for stressing complementary profiled closure shapes of a sachet (marked respectively $P_1$, $P_2$ and S in FIG. 1), by moving towards or moving away according to the direction of displacement of the slider along these profiled shapes. The expression "internal space" means the space delimited by the base 10 and the flanks 11 and 12.

In this case, these means comprise a longitudinal rib 13 which extends according to the median longitudinal plane of the slider.

This rib 13, originating from material with the inner face of the base 10, separates the internal space into two corridors $C_1$ and $C_2$.

Figure 3:
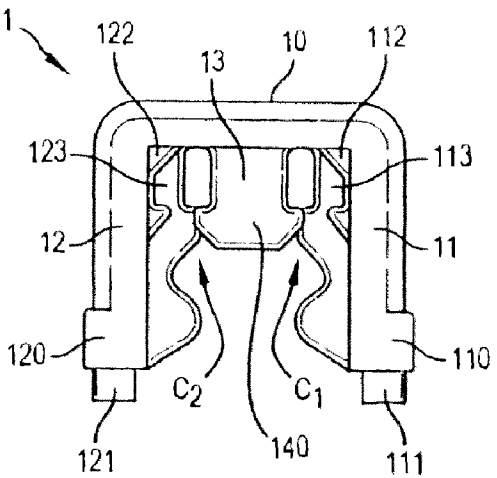
FIG. 3 is an end view of the slider of FIG. 2.
Figure 5:
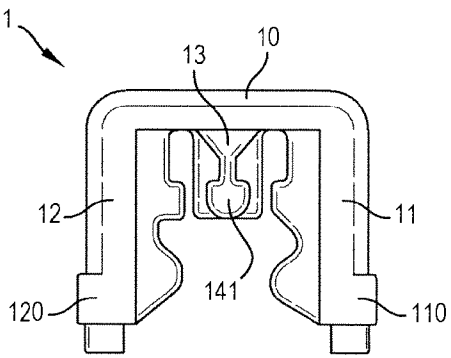
FIG. 5 is an end view of the slider of FIG. 2, according to a direction opposite that of FIG. 3.
Figure 10:
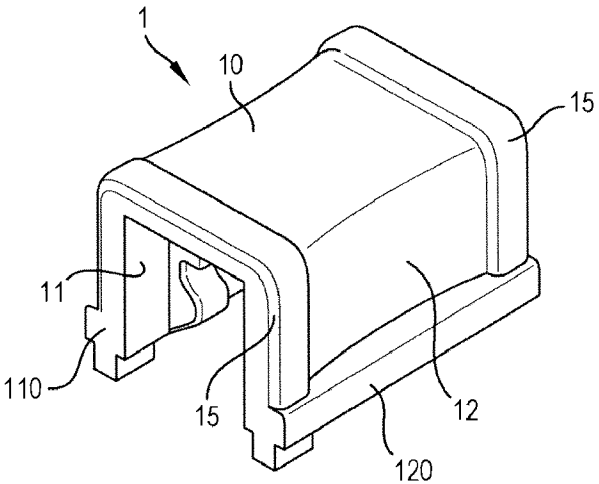
FIG. 10 is a view of the slider according to the invention, in perspective.
Figure 9:
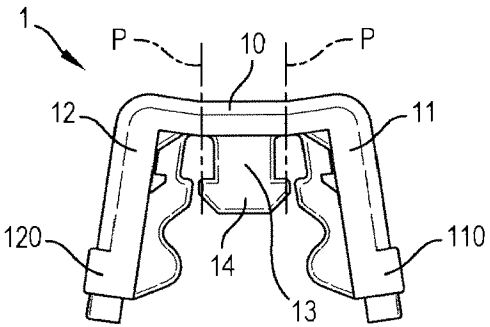
FIG. 9 is a view similar to FIG. 3, the flanks being illustrated in a spread position.

As shown more particularly in FIGS. 3 and 5, the rib extends downwards via an elongated central base 14 which overflows on either side of the rib 13 to constitute guide facets of a protuberance $T_1$, $T_2$ (see FIG. 1), here in the form of a point of an arrow, situated above an associated profiled closure shape $P_1$, $P_2$. Each facet is turned to the base 10.

"Protuberance"denotes any means associated with the corresponding profiled shape, which allows the slider to cooperate with the sachet.

This base 14 comprises a first "wide" part 140, in the general form of an iron base to be smoothed (that is, overall triangular when viewed from above), which is prolonged by a narrower part 141.

Also, opposite the two parts 140 and 141 of the base 14, the inner faces of the flanks 11 and 12 each bear a projection 112, 122, respectively 113, 123, which is also provided with a guide facet of a protuberance.

The corridors $C_1$ and $C_2$ are therefore delimited by the base 10, the rib 13 and its associated base 14, the inner faces of the flanks 11 and 12 and their associated projections. In other terms, the corridors $C_1$ and $C_2$ have the form of throats with convergent edges.

Figure 8:
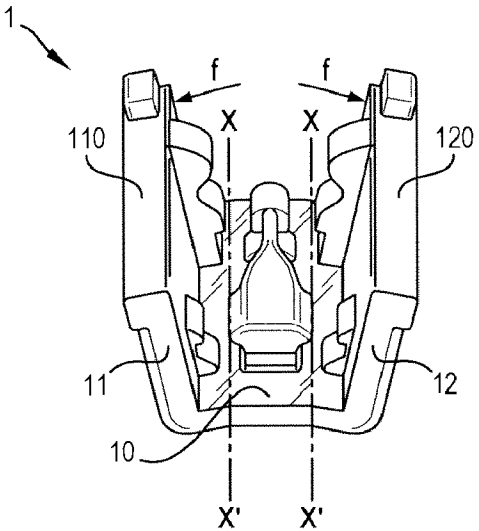
FIG. 8 is a view equivalent to FIG. 2, the flanks being illustrated in a spread position.

As is evident from FIGS. 2 and 8, the corridors $C_1$ and $C_2$ extend only over part of the longitudinal range of the slider, in this case near each of its opposite ends.

According to the invention, along the longitudinal free rim of each flank 11 and 12 extends a stiffening bar 110, respectively 120, of a greater thickness than the remaining part of the flank, projecting to the outside of the slider.

This bar advantageously has a constant thickness and the thickness flank/bar ratio is preferably between 1.5 and 2.5.

To the extent where the slider is advantageously a piece made of plastic material produced by injection moulding, the bars are preferably made of a single piece with the latter. However, it is possible to employ click-on bars on the slider.

In the example shown here, each bar 110 and 120 has on its free face, opposite the base 10, a keying finger 111, respectively 121.

In an embodiment which is not shown here, the slider could have the general structure described in French Patent application No. 07 59545 (publication: FR-A-2 924 312), in which load pins are provided in the extension of the flanks 11 and 12.

In the figures, it is evident that the opposite ends of the slider conform to arches 15, of a thickness greater than the rest of its body.

In an attempt to deform the slider according to the invention, in order to place profiled shapes such as those $P_1$ and $P_2$ of FIG. 1, the flanks 11 and 12 are moved apart from one another, for example by exerting a force on their inner face, as shown by arrows f of FIG. 8. This allows the corridors $C_1$ and $C_2$ to be "opened" and enables placing of the profiled shapes.

Once this operation is done, the force is stopped and the flanks naturally regain their initial position.

This force is applied most closely to the free end of the flanks to produce the biggest possible lever arm.

The presence of the bars 110 and 120 results in overall rigidity of the flanks 11 and 12, such that their displacement tends to move them apart without "parasitic" deformation which would impart an arched shape.

Of course, the slider "folds" in those zones where there is least material. These "fold zones" correspond to the regions of the base 10 deprived of material outgrowth.

These zones are marked X-X' in FIG. 2 and in FIG. 8.

The invention claimed is:

1. A slider for actuating profiled closure shapes for a closure assembly equipping a sachet, comprising:

a base, two flanks, means adapted for stressing respectively said profiled closure shapes, by moving towards or moving away according to a direction of displacement of the slider along the profiled closure shapes, such that the profiled closure shapes are movable between a closed latch position and an open separated position, and a stiffening bar extending along a longitudinal free edge of each of the two flanks, wherein the stiffening bar has a greater thickness than a thickness of its respective flank, extends over an external face of its respective flank, is made from a piece with its respective flank, and has a same longitudinal range as its respective flank such that the stiffening bars impart substantial rigidity to the overall slider.

2. The slider as claimed in claim 1, wherein each stiffening bar has a constant thickness such that its bar thickness/flank ratio is between 1.5 and 2.5.

3. The slider as claimed in claim 1, further comprising load pins projecting on said flanks, in a vicinity of an end thereof opposite said base, for opening the slider provisionally and enabling its engagement on said profiled closure shapes when stress is exerted on said pins.

4. The slider as claimed in claim 1, wherein the means for stressing respectively said profiled closure shapes comprise a longitudinal rib which subdivides at least part of an inner space of the slider into two corridors, wherein the rib extends from a rib base on either side of said rib so as to constitute guide facets of a protuberance associated with said profiled closure shapes.

5. The slider as claimed in claim 1, wherein the slider is configured such that, when the slider is displaced so as to move the closure shapes between the closed latch position and the open separated position after being attached to the satchet, the stiffening bars protrude outwardly from sides of the slider so as to have visible upper surfaces and opposing visible lower surfaces.

6. The slider as claimed in claim 1, wherein the slider is configured such that, when the slider is displaced so as to move the closure shapes between the closed latch position and the open separated position after being attached to the satchet, the stiffening bars protrude outwardly from sides of the flanks so as to have visible parallel upper and lower surfaces.

7. The slider as claimed in claim 1, wherein the two flanks in initial positions are configured to be parallel to each other such that, when force is applied to the free ends so at to move the free ends apart from one another, the flanks return to their initial positions when the force is stopped.

8. A slider for actuating profiled closure shapes for a closure assembly equipping a sachet, comprising:

a base, two flanks, projections adapted for stressing respectively said profiled closure shapes, by moving towards or moving away according to a direction of displacement of the slider along the profiled closure shapes, such that the profiled closure shapes are movable between a closed latch position and an open separated position, and a stiffening bar extending along a longitudinal free edge of each of the two flanks, wherein the stiffening bar has a greater thickness than a thickness of its respective flank, extends over an external face of its respective flank, is made integrally with its respective flank, and has a same longitudinal range as its respective flank such that the stiffening bars impart substantial rigidity to the overall slider.

9. The slider as claimed in claim 8, wherein each stiffening bar has a constant thickness such that its bar thickness/flank ratio is between 1.5 and 2.5.

10. The slider as claimed in claim 8, further comprising load pins projecting on said flanks, in a vicinity of an end thereof opposite said base, for opening the slider provisionally and enabling its engagement on said profiled closure shapes when stress is exerted on said pins.

11. The slider as claimed in claim 8, wherein one of the projections is a longitudinal rib which subdivides at least part of an inner space of the slider into two corridors, wherein the rib extends from a rib base on either side of said rib so as to constitute guide facets of a protuberance associated with said profiled closure shapes.

12. The slider as claimed in claim 8, wherein the slider is configured such that, when the slider is displaced so as to move the closure shapes between the closed latch position and the open separated position after being attached to the satchet, the stiffening bars protrude outwardly from sides of the slider so as to have visible upper surfaces and opposing visible lower surfaces.

13. The slider as claimed in claim 8, wherein the slider is configured such that, when the slider is displaced so as to move the closure shapes between the closed latch position and the open separated position after being attached to the satchet, the stiffening bars protrude outwardly from sides of the flanks so as to have visible parallel upper and lower surfaces.

14. The slider as claimed in claim 8, wherein the two flanks in initial positions are configured to be parallel to each other such that, when force is applied to the free ends so at to move the free ends apart from one another, the flanks return to their initial positions when the force is stopped.

* * * * *